US005836070A

United States Patent [19]

Arena

[11] Patent Number: 5,836,070

[45] Date of Patent: Nov. 17, 1998

[54] METHOD AND FORMING DIE FOR FABRICATING TORQUE JOINTS

[75] Inventor: Aldo Arena, Smithtown, N.Y.

[73] Assignee: Northrop Grumman Corporation, Los Angeles, Calif.

[21] Appl. No.: 655,063

[22] Filed: May 29, 1996

Related U.S. Application Data

[63] Continuation-in-part of Ser. No. 226,720, Apr. 12, 1994, abandoned.

[51] Int. Cl.[6] ..... B21D 39/00; B21D 28/18

[52] U.S. Cl. ..... 29/523; 72/62

[58] Field of Search ..... 29/522.1, 523; 72/61, 62, 370, 707

[56] References Cited

U.S. PATENT DOCUMENTS

| | | | |
|---|---|---|---|
| 3,810,372 | 5/1974 | Queyroix | 72/56 |
| 4,125,000 | 11/1978 | Grob | 64/23 |

*Primary Examiner*—David P. Bryant
*Assistant Examiner*—Tisa Stewart
*Attorney, Agent, or Firm*—Terry J. Anderson; Karl J. Hoch, Jr.

[57] ABSTRACT

A method for the fabricating or forming of tubular members of the torque tube type which may be utilized as torque joints for the drive shafts or steering connections of motor vehicles or in connection with articulating linkages for high-lift aircraft systems or for other various physical application where it is intended to react to torsional and axial loads which are ordinarily encountered in torque joints, steering linkages, drive shafts and the like. Provision is also made for a device which is in the form of a novel external die arrangement for electromagnetically concurrently forming longitudinal and circumferential or radial grooves in tubular members and interposed end fittings, particularly of the type which are adapted to react to torsional and axial loads encountered by torque joints and the like. For the concurrent formation of longitudinal and circumferential or radial grooves, the external die which encompasses the area of the components which is to be joined, has grooves or recesses machined in the circumferential inner surface of the die such that upon the generating of an electromagnetic force by means of an internal coil arranged within the area which is to be deformed, the superimposed tubular member and end fitting material is expanded outwardly so as to enter the recesses or grooves which are present in the inner encompassing surface of the external die. As a result, the interlocking groove structure or pattern formed in the tubular member and end fitting produces a torque joint which is adapted to react to both axial and torsional forces and loads imposed thereon.

24 Claims, 3 Drawing Sheets

METHOD AND FORMING DIE FOR FABRICATING TORQUE JOINTS

CROSS-REFERENCE TO RELATED PATENT APPLICATIONS

This application is a continuation-in-part patent application of Ser. No. 08/226,720, filed on Apr. 12, 1994, now abandoned.

BACKGROUND OF THE INVENTION

1. Field of the Invention

The present invention relates to a method for the fabricating or forming of tubular members of the torque tube type which may be utilized as torque joints for the drive shafts or steering connections of motor vehicles or in connection with articulating linkages for high-lift aircraft systems or for other various physical application where it is intended to react to torsional and axial loads which are ordinarily encountered in torque joints, steering linkages, drive shafts and the like. More particularly, pursuant to a further aspect of the invention, provision is made for a device which is in the form of a novel external die arrangement for electromagnetically concurrently forming longitudinal and circumferential or radial grooves in tubular members and interposed end fittings, particularly of the type which are adapted to react to torsional and axial loads encountered by torque joints and the like.

In essence, it is a common procedure to form grooves in tubes and end fittings which are to be utilized in the fabrication of torque joints for drive shafts and the like in order to be able to react to torsional and axial loads which are encountered in the drive shafts. Heretofore, such grooves were generally produced by machining the tubular members in a labor-intensive and time-consuming manner, thereby rendering the entire process of their manufacture expensive and economically not viable.

2. Discussion of the Prior Art

Pursuant to the more recent state of the technology employed in the manufacture of so-called conformal torque tube joints incorporating grooves in both longitudinal and circumferential orientations in order to produce a torque joint of interlockingly formed tubular members, the end fitting and the thereon or therein located tube were normally joined together by concurrently forming torque-reacting grooves over an internal shaped die member or mandrel so as to eliminate the necessity for machining the grooves in the end fitting.

For example, a method of fabricating a torque joint incorporating longitudinal or axial grooves and also providing for circumferentially extending of radial grooves may be ascertained in Arena U.S. Pat. No. 4,513,488 which enable the transmission of forces or loads in both longitudinal or circumferential directions through the intermediary of thin-walled and resultingly lightweight tubular torque tubes. In that instance, an inner tube and an outer tube are overlapped, a mandrel possessing longitudinal and circumferential grooves inserted therein, and an externally applied deformation force compresses the tubular members into the grooves in the mandrel, whereupon the mandrel or at least a portion of the mandrel is extracted to then provide the formed torque joint.

In Arena, et al. U.S. Pat. No. 4,523,872, there is disclosed a torque tube employing end members interconnected by tubular member, wherein the end members are provided with a male extension having radially spaced, axially extending grooves with the number of grooves, outer diameter of each end member, groove width and groove length being in prescribed proportions and ratios. The ends of the tubular member are positioned over the male end member extension and the tube walls conformed to the end member and grooves through the external application of electromagnetic energy so as to cause the tube walls to be recessed or radially inwardly compressed into the grooves.

Various methods and apparatus describing the formation of grooves in tubular members in either mechanical or electromagnetic modes, particularly such as for the formation of torque joints and the like suitable for diverse physical applications are disclosed in Suh, et al. U.S. Pat. No. 4,397,171; Ohki U.S. Pat. No. 4,598,451; Queyroix U.S. Pat. No. 3,810,372; Grob U.S. Pat. No. 4,125,000; Clements U.S. Pat. No. 2,233,471; Savon U.S. Pat. No. 1,329,479; and Bright, et al. U.S. Pat. No. 1,291,388.

Each and every one of the foregoing patents, although disclosing the formation of grooves in tubular members, for example, such as for the formation of torque joints for drive shafts, aircraft control linkages, and the like, disclose either mechanical devices for compressing the material and/or electromagnetic force-generating devices which are normally externally applied so as to form longitudinal and circumferential grooves, or devices generating internal electromagnetic forces to provide longitudinally extending grooves in tubular members.

SUMMARY OF THE INVENTION

In accordance with the present invention, in clear contrast with the foregoing, and in a unique and novel manner of forming conformal torque joints from interengaged tubular members and end fittings; in effect, for the concurrent formation of longitudinal and circumferential or radial grooves, an external die which encompasses the area of the components which is to be joined, has grooves or recesses machined in the circumferential inner surface of the die such that upon the generating of an electromagnetic force by means of an internal coil arranged within the area which is to be deformed, the superimposed tubular member and end fitting material is expanded outwardly so as to enter the recesses or grooves which are present in the inner encompassing surface of the external die. As a result, the interlocking groove structure or pattern formed in the tubular member and end fitting produces a torque joint which is adapted to react to both axial and torsional forces and loads imposed thereon.

The formation of the conformal torque tubes or joints with both axially or longitudinally extending grooves and also circumferential or radial grooves enables the reaction to encountered torsional and axial loads. Furthermore, through the expansive deformation of the material of the tubes or tubular members, in contrast with compressive deformation, there is a reduction in axial stress concentrations which are normally encountered during the compression of the material, while the expansion of the material is also preferred in order to increase the moments of inertia and the torque loading capabilities of such torque joints. Moreover, the utilization of an internal coil to generate the electromagnetic forces rather than an external coil and internal mandrel, causes the coil to be more stable so as not to tend to degrade with repeated use as is the case with external coils.

The formation of the conformal torque joints or tubular members of the type described herein through the inventive forming method facilitates their utilization over a wide range of applications; i.e., in mechanical systems in which it is desired to transmit driving forces or loads; for example, such as in automotive drag links or steering arrangements, or aircraft control, as well as for drive shafts of automobiles. The torque joints may also be utilized for the transmission of loads in structures located in mechanisms for positioning and controlling airflow surfaces of aircraft or the like.

Accordingly, in order to provide a method for the formation of a conformal torque joint incorporating both axial and circumferential or radial grooves which are in a predetermined spaced relationship relative to each other, the present invention contemplates the provision of an external die which may be of a construction having hinged cooperating die portions to enable the pivotable opening and closing thereof, and in which raised ridges are formed in the internal cylindrical surface of the external die, which extend in both axial and circumferential directions, so that upon the closing and latching of the external die about the tubular members which are to form a torque joint, and the energizing of an internal coil arranged within the tubular members so as to generate an electromagnetic force in this area within the external die, the material of the tubular members will be expanded so as to conformingly engage the surface portions of the inner cylindrical wall structure of the external die, thereby producing a composite pattern or arrangement of outwardly displaced tubular surfaces having inwardly directed axial and circumferential or radial grooves formed in the tube members which are reactive to both axial and torsional forces which may be applied to the tube members of the resultingly formed torque joint.

In accordance with a further embodiment of the invention, the internal cylindrical surface of the external die, rather than being provided with raised ridges so as to form inwardly depending grooves in the tubular members producing the torque joint, in this instance the inner cylindrical surface of the external die is provided with axially extending and circumferentially spaced recesses and at least one transverse or radial recess at a predetermined axial location relative to the axial recesses, whereby upon the generation of an electromagnetic force internally of the tubular members the latter have the diameters deformed thereof so as to incorporate outwardly projecting axial and radial ridges rather than the inwardly depending grooves as in the previous embodiment.

Pursuant to a modified embodiment of the invention, the internal cylindrical surface of the external die may have an inwardly extending annular flange or shoulder formed at one end thereof so as to facilitate an accurate axial positioning or insertion of the tubular members whereby, upon outward deformation or expansion of the tubular members, as described hereinabove, the end of the axial length thereof located within the annular flange of the die will have an annular configuration forming a stepped-down end of smaller diameter adjoining an end fitting of the torque joint.

According to a specific feature of the present invention, the external die may comprise a pair of die halves of essentially complementary configuration which are hingedly interconnected so as to be pivotable about an axial or longitudinal center plane or hinge line and which, when closed into an operative position about the tubular member and/or end fitting, has the die halves latched together through suitable interengaging bolts or pins extending through locking apertures, or fastened together by suitable releasable clamping devices, as is known in the technology.

The internal cylindrical or circumferential surface of the external die halves, in one embodiment thereof, may be provided with suitably machined axial grooves, and one or more circumferentially or radially extending grooves, or in another embodiment consisting of raised ridges rather than grooves, whereby the outer tubular member, which may have another tubular member or end fitting inserted therein or positioned thereon to form the conformal tube joint is essentially of the same diameter as the cylindrical grooved surface of the external die. Upon the application of a suitable electromagnetic force or current to an internal coil positioned within the tubular members in the region located within the confines of the die, the material of the tubular members will expand so as to fill the spaces or lands between the ridges or expanded into the grooves, thereby forming the axial and circumferential grooves in the conformed tubular members and producing a torque joint which is able to react to both longitudinal and torsional loads or forces.

Accordingly, it is a primary object of the present invention to provide a method for forming axial and radial grooves in a conformal tubular torque joint through the application of an internal electromagnetic force expanding the tube into grooves or spaced between ridges in the internal encompassing cylindrical surface of an external die structure.

Another object of the present invention is to provide a novel method of forming conformal torque joints and grooved tubular members whereby at least a decreased diameter end structure is produced adjacent one of the ends of axial grooves formed in the torque joint.

Still another object of the present invention is to provide an external die having an internal cylindrical surface encompassing tubular members and incorporating axial and circumferential grooves or raised ridges enabling expansion of the tubular members through the application of an internal electromagnetic force so as to form a conformal torque joint having axial and radial grooves therein.

Yet another object of the present invention is to provide an external die for the formation of torque joints incorporating both axial and circumferential grooves through the application of an internal electromagnetic force, whereby the external die is of split and hingedly connected construction enabling the rapid closure thereof and formation of the torque joint, and facilitating the subsequent opening of the die to enable removal of the torque joint.

BRIEF DESCRIPTION OF THE DRAWINGS

Reference may now be had to the following detailed description of preferred embodiments of the invention, taken in conjunction with the accompanying drawings; in which.

DETAILED DESCRIPTION OF PREFERRED EMBODIMENTS

Figure 1:
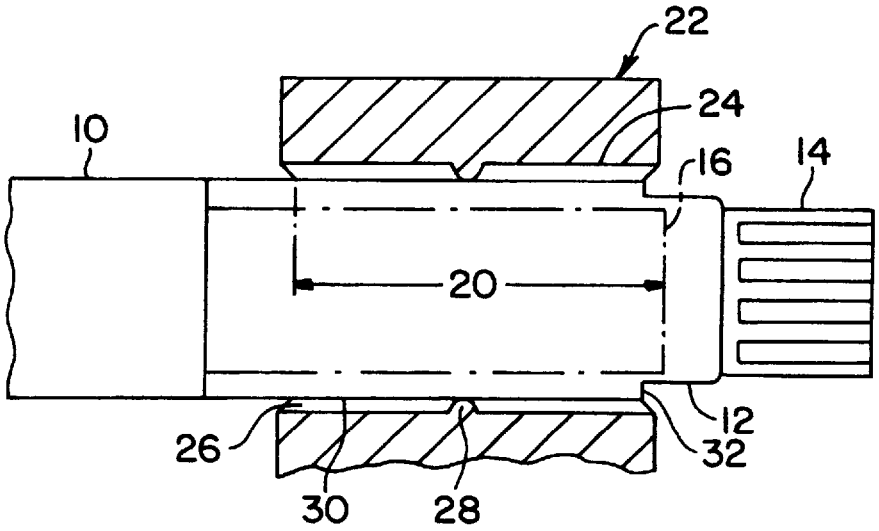
FIG. 1 illustrates a generally schematic longitudinal sectional view of a tubular member and end fitting arranged to be formed into a torque joint through the inventive external die structure.
Figure 2:
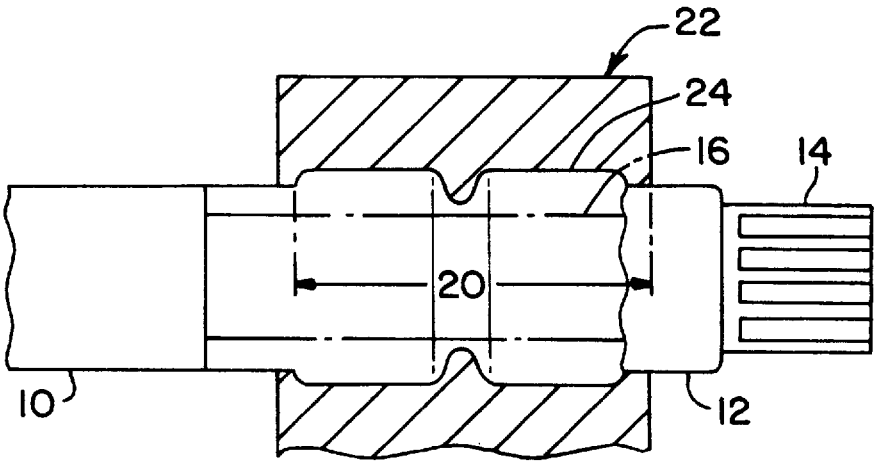
FIG. 2 illustrates the tubular member and end fitting of FIG. 1 shown in their deformed position to constitute a torque joint produced pursuant to the invention.

Referring in particular to FIGS. 1 and 2 of the drawings, shown therein are a pair of tubular members 10, 12, each preferably consisting of aluminum or other light-weight metal in order to be able to form a light-weight torque joint, in which a first of the tubular members 10 has the second tubular member 12 inserted therein in close slidable engagement, or alternatively adapted to extend thereover, and with the second tubular member 12 shown as having a splined end 14 for providing a fitting connection with a suitable drive arrangement or the like structure (not shown). In lieu of the splined end 14, the second tubular member 12 may be an end fitting which possesses a clevis-type or bifurcated structure (not shown) for forming a linkage connection, such as for an automobile steering control system or for an aircraft actuating linkage system for controlling airfoil flow surfaces and the like, although other numerous physical applications lend themselves to the present invention in widely diverse industries requiring the use of torque joints.

As shown in FIG. 1, a suitable electrical coil member 16 is adapted to be inserted into the superimposed tubular members 10, 12 and connected to a source of electrical current to provide for the generating of an electromagnetic force. Encompassing the outer circumference of the assembled tubular members 10, 12 within the region 20 is an annular die 22. The annular die 22 has an inner cylindrical surface 24 provided with radially inwardly protruding circumferentially spaced raised axial ridges 26 and at least one circumferential ridge 28 whose apices contact the outer circumferential surface 30 of the outer one of the tubular members 10, 12. This, in essence, provides for an annular space 32 between the inner cylindrical surface 24 of the die 22 and the outer circumferential surface 30. Upon the application of an electromagnetic force to the tubular members 10, 12 by means of the electrical coil member 16, this will expand and deform the tubular members 10, 12 conjointly radially outwardly. The lands or surface portions of the cylindrical die surface 24 intermediate the inwardly depending raised ridges 26, 28, and which initially forms the annular space 32 about the outer surface 30 of the tubular members 10, 12, has the tubular members deformed therein so as to produce radially inwardly extending axial and circumferential grooves 38, 40 conjointly in the tubular members 10, 12 interlocking in nature and which will form a fixed connection between the tubular members in the form of a torque joint reactively secured against encountered rotational and axial torsional forces, as also illustrated in FIG. 3.

Figure 3:
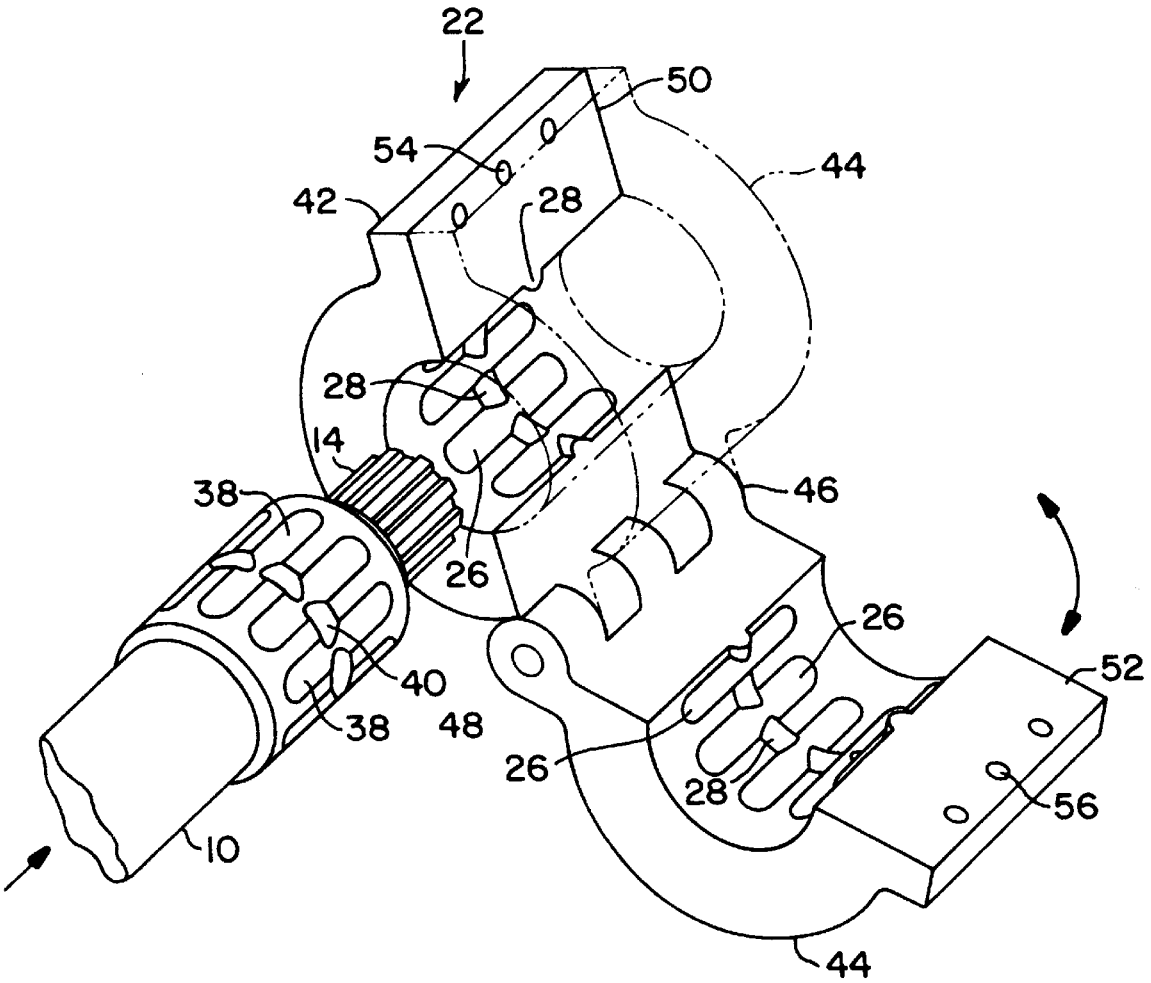
FIG. 3 illustrates an exploded perspective view of the formed torque joint and the external forming die axially displaced for producing the torque joint shown in an opened condition.

In essence, as shown in perspective representation in FIG. 3 of the drawings, the diameters of the superimposed tubular member portions within the die 22 defined by the region 20 are expanded to the cylindrical surface 24 of the inside of the external die 22, whereby the circumferentially spaced axial grooves 38 and the at least one radial groove 40 in the tubular members 10, 12 extend radially inwardly from the expanded surfaces thereof.

As shown in FIG. 3, the external die 22, which is of a heavy or solid metallic or of a composite or dense plastic material construction, may consist of a plurality of pivotably hinged sections adapted to form an openable and closable die structure; for example, consisting of two, three or an even larger number of hinged die sections. In this particular embodiment, as illustrated in the drawing, at least two mating semi-circular halves 42, 44 which are pivotally joined along one edge 46 by a suitable hinge structure 48, and in which mating flange structures 50, 52 at the opposite ends of the die halves include either mutually aligning apertures 54, 56 facilitating the passage therethrough of locking bolts in the closed position of the die, or any other suitable clamping device attachable thereto for latching the die into its closed operative structure, as shown by the phantom lines, extending about the tubular members 10, 12, as illustrated in FIGS. 1 and 2 of the drawings. Thereafter, upon the implementation of the electromagnetic force by means of the internal coil member 16 which is inserted into the superimposed tubular members 10, 12 within the region 20 of the encompassing die 22, the material of the outwardly expanding deformed tubular member extends into conformed contact with the inner surface of die 22 and fills the interspaces or lands between the radially inwardly extending ridges 26, 28 on the die surface 24 so as to form the plurality of circumferentially spaced axially extending grooves 38 and the at least one radially extending groove 40 in the conjointly deformed tubular members 10, 12.

Although as illustrated in the drawings, in which there has been shown only a single annular or radial groove 40 located approximately in the middle of the axial length of the longitudinal axial grooves 38, it is possible within the inventive concept to provide one or more of such radial grooves 40 axially spaced at suitable locations within region 20 along the tubular members 10, 12, as may be desired for a specific application.

Upon completion of the expansion or forming process, the external die 22 is opened by the die halves 42, 44 being swung apart at the hinge structure 48 so as to enable removal of the formed torque joint and facilitating positioning a new set of superimposed tubular members 10, 12 therein, inserting internal coil member 16 and repeating the cycle, as previously described in order to form a torque joint.

Figure 4:
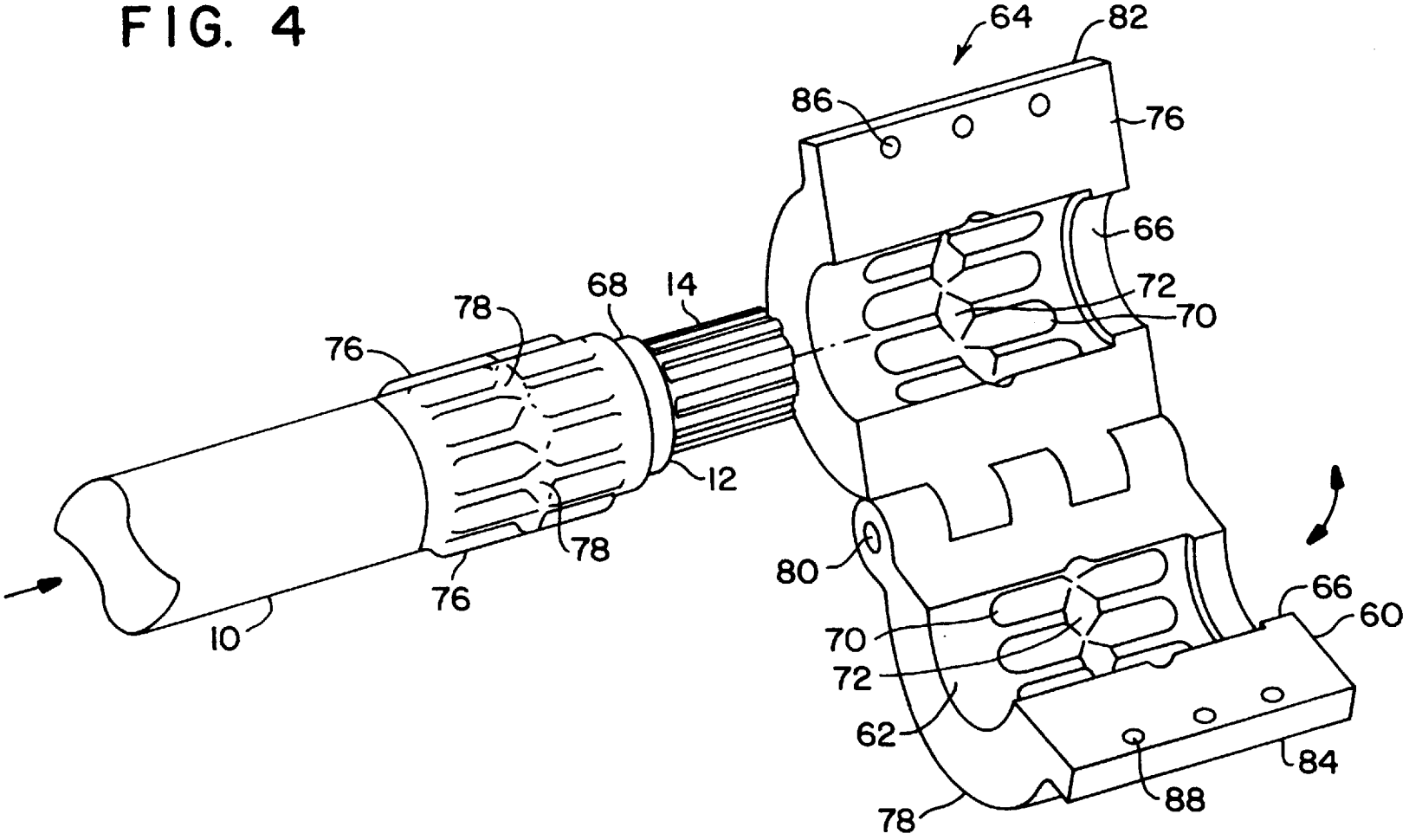
FIG. 4 illustrates, in a view similar to FIG. 3, a second embodiment of a torque joint and of a forming die for producing a torque joint.

With respect to the embodiment of FIG. 4 of the drawings in which similar or identical elements are identified by the same reference numerals as in FIG. 3, in that instance one edge 60 of the inner cylindrical surface 62 of the external die 64 is optionally provided with an annular inwardly extending flange or shoulder 66 of smaller diameter so as to control the extent to which the tubular members 10, 12 are axially inserted therein, and whereby upon the application of the electromagnetic force through the internal coil member 16, as in the previous embodiment, not only will there be formed the axial or longitudinal grooves and radial groove to produce the torque joint, but concurrently a smaller diameter annulus 68 adjacent the fluted or splined end 14 of the one of the tube elements 12 which projects from the external forming die 64.

Moreover, as illustrated in this particular embodiment, rather than being provided with radially inwardly extending ridges 26, 28 in the inner cylindrical die surface as in FIG. 3, which produces radially inwardly extending axial and radial grooves in the tubular members 10, 12 of the torque joint, in this embodiment of FIG. 4, the surface 62 of the external die 64 is provided with or has machined therein circumferentially spaced axial recesses 70 and at least one radial recess 72 so that upon the generating of the electromagnetic force by means of the coil member 16 arranged within the tubular members 10, 12, the basic diameters of the tubular members 10, 12 will remain essentially undeformed; however, portions thereof will expand or be deformed radially outwardly into the recesses 70, 72 in the cylindrical surface 62 of the external die 64, thereby forming conjointly raised axial and radial ridges 76, 78 in the tubular members 10, 12 producing the torque joint. As in the previous embodiment, the number of axial ridges formed is arbitrary and selected in accordance with the particular physical application intended for the torque joint, whereas there may also be provided one or more radial ridges spaced along the axial length of the axial ridges, as desired.

Additionally, although in FIG. 4 of the drawings the recesses 70, 72 which are formed in the die surface 62 extend radially outwardly, these may be formed to extend radially inwardly in the form of raised surface portions or ridge elements as in the external die 22 shown in FIG. 3 of the drawings, so as to form radially inwardly depending grooves in the tubular members rather than radially outwardly projecting ridges.

As in the previous embodiment, in this instance the external die 64 is similarly formed of at least two die halves 76, 78 or more hinged die sections as necessary to prevent interlocking of the formed tube with the die in the closed position of the latter, after the tube and end fitting material has been formed into the die. The die halves, or die sections as required, are adapted to be interconnected by means of a suitable pivot or hinge structure 80 and locked together by means of suitable bolts extending through aligned apertures 86, 88 formed in a mating flange structure 82, 84 on the opposite ends of the die halves. Alternatively, any type of suitable clamping arrangement may be employed to maintain the die halves in a closed latched position during the forming of the torque joint.

While there has been shown and described what are considered to be preferred embodiments of the invention, it will, of course, be understood that various modifications and changes in form or detail could readily be made without departing from the spirit of the invention. It is, therefore, intended that the invention be not limited to the exact form and detail herein shown and described, nor to anything less than the whole of the invention herein disclosed as hereinafter claimed.

What is claimed is:

1. A method of fabricating a torque joint between two tubular members having one end of one tubular member inserted into an end of the other tubular member to provide an overlapping region between the tubular members; comprising the steps of:

(a) encompassing the overlapping region of said tubular members with an annular die having an inner cylindrical surface facing the outer surface of said overlapping region, said annular die comprising a plurality of mating die sections hingedly interconnected to enable insertion of said tubular members and extraction thereof in the open position of said die sections, said inner surface of said annular die having a plurality of circumferentially spaced axially extending ridges and at least one radial ridge extending about said inner surface, said ridges projecting radially inwardly and contacting the outer circumferential surface of said tubular members upon closing of said mating die sections, and said inner surface of said die defining an annular space with the outer circumferential surface of said tubular members;

(b) inserting an electrical coil member which is connected to a source of electrical energy into said tubular members so as to extend into said overlapping region within the confines of said annular die;

(c) applying an electrical current to said coil member by said source of electrical energy so as to impart an electromagnetic force to the interior of said tubular members in said overlapping region by said coil member to generate a deformation force expanding said tubular members radially outwardly within said overlapping region so as to impress said pattern of ridges on said inner die surface onto said tubular members to produce a corresponding pattern, of axial and radial grooves therein forming said torque joint; and (d) opening the hingedly interconnected mating die sections upon completion of the formation of said grooves so as to facilitate extraction of said torque joint from said annular die.

2. A method as claimed in claim 1, wherein said tubular members are expanded within said overlapping region to an outer diameter of a size substantially that of the diameter of the inner cylindrical surface of said annular die.

3. A method as claimed in claim 1, wherein said annular die includes an annular inwardly extending shoulder at one edge of the inner cylindrical surface, said shoulder limiting axial insertion of said tubular members into said die and forming a reduced diameter area on said tubular members adjacent the grooves formed therein upon expansion of said tubular members responsive to said electromagnetic force.

4. A method as claimed in claim 1, wherein a plurality of said radial grooves are formed in said tubular members spaced along the length of the formed axial grooves so as to provide a predetermined pattern of grooves reacting to axial and torsional loads imparted to the formed torque joint.

5. A method as claimed in claim 1, wherein at least one of said tubular members comprises an end fitting for a torque joint.

6. A method as claimed in claim 1, wherein said electromagnetic coil member insertable into said tubular members has an outer diameter of substantially the size of the internal diameter of said tubular member within said overlapping region.

7. A method of fabricating a torque joint between two tubular members having one end of one tubular member inserted into an end of the other tubular member to provide an overlapping region between the tubular members; comprising the steps of:

(a) encompassing the overlapping region of said tubular members with an annular die having an inner cylindrical surface facing the outer surface of said overlapping region, said annular die comprising a plurality of mating die sections hingedly interconnected to enable insertion of said tubular members and extraction thereof in the open position of said die sections, said inner surface of said annular die having a plurality of circumferentially spaced axially extending recesses and at least one radial recess extending radially outwardly so as to enable said inner surface to contact the outer circumferential surface of said tubular members;

(b) inserting an electrical coil member which is connected to a source of electrical energy into said tubular members so as to extend into said overlapping region within the confines of said annular die;

(c) applying an electrical current to said coil member by said source of electrical energy so as to impart an electromagnetic force to the interior of said tubular members in said overlapping region by said coil member to generate a deformation force expanding said tubular members radially outwardly within said overlapping region so as to impress said pattern of recesses on said inner die surface onto said tubular members to produce a corresponding pattern of axial and radial outwardly expanded grooves therein forming said torque joint; and (d) opening the hingedly interconnected mating die sections upon completion of the formation of said grooves so as to facilitate extraction of said torque joint from said annular die.

8. A method as claimed in claim 7, wherein said tubular members are expanded within said overlapping region to an outer diameter of a size substantially that diameter of the configuration of the inner cylindrical surface of said annular die.

9. A method as claimed in claim 7, wherein said annular die includes an annular inwardly extending shoulder at one edge of the inner cylindrical surface, said shoulder limiting axial insertion of said tubular members into said die and forming a reduced diameter area on said tubular members adjacent the grooves formed therein upon deformation of said tubular members responsive to said electromagnetic force.

10. A method as claimed in claim 7, wherein a plurality of said radial grooves are formed in said tubular members spaced along the length of the formed axial grooves so as to provide a predetermined pattern of grooves reacting to axial and torsional loads imparted to the formed torque joint.

11. A method as claimed in claim 7, wherein at least one of said tubular members comprises an end fitting for a torque joint.

12. A method as claimed in claim 7, wherein said electromagnetic coil member insertable into said tubular members has an outer diameter substantially the size of the internal diameter of said tubular member within said overlapping region.

13. A die structure for fabricating a torque joint between two tubular members having one end of one tubular member inserted into an end of the other tubular member inserted into an end of the other tubular member to provide an overlapping region between the tubular members; comprising:

(a) said die structure encompassing the overlapping region of said tubular members including an annular die having an inner cylindrical surface facing the outer surface of said overlapping region, said inner surface of said annular die having a plurality of circumferentially spaced axially extending ridges and at least one radial ridge extending about said inner surface, said annular die comprising a plurality of mating die sections hingedly interconnected to enable insertion of said tubular members and extraction thereof in the open position of said die sections, said ridges projecting radially inwardly so as to contact the outer circumferential surface of said tubular members in the closed condition of said mating die sections, and said inner surface of said die defining an annular space with the outer circumferential surface of said tubular members;

(b) an electrical coil member which is connected to a source of electrical energy being inserted into said tubular members so as to extend into said overlapping region within the confines of said angular die; and (c) said coil member having an electrical current applied thereto by said source of electrical energy for imparting an electromagnetic force to the interior of said tubular members in said overlapping region so as to generate a deformation force expanding said tubular members radially outwardly within said overlapping region so as to impress said pattern of ridges on said inner die surface onto said tubular members to produce a corresponding pattern of axial and radial grooves therein forming a torque joint.

14. A die structure as claimed in claim 13, wherein said tubular members are expanded within said overlapping region to an outer diameter of a size substantially that of the diameter of the inner cylindrical surface of said annular die.

15. A die structure as claimed in claim 13, wherein said annular die includes an annular inwardly extending shoulder at one edge of the inner cylindrical surface, said shoulder limiting axial insertion of said tubular members into said die and forming a reduced diameter area on said tubular members adjacent the grooves formed therein upon expansion of said tubular members responsive to said electromagnetic force.

16. A die structure as claimed in claim 13, wherein a plurality of said radial grooves are formed in said tubular members spaced along the length of the formed axial grooves so as to provide a predetermined pattern of grooves reacting to axial and torsional loads imparted to the formed torque joint.

17. A die structure as claimed in claim 13, wherein at least one of said tubular members comprises an end fitting for a torque joint.

18. A die structure as claimed in claim 13, wherein said electromagnetic coil member insertable into said tubular members has an outer diameter of substantially the size of the internal diameter of said tubular member within said overlapping region.

19. A die structure for fabricating a torque joint between two tubular members having one end of one tubular member inserted into an end of the other tubular member to provide an overlapping region between the tubular members; comprising:

(a) said die structure encompassing the overlapping region of said tubular members including an annular die having an inner cylindrical surface facing the outer surface of said overlapping region, said inner surface of said annular die having a plurality of circumferentially spaced axially extending recesses and at least one radial recess extending about said inner surface, said annular die comprising a plurality of mating die sections hingedly interconnected to enable insertion of said tubular members and extraction thereof in the open position of said die sections, said recesses extending radially outwardly so as to enable said inner surface to contact the outer circumferential surface of said tubular members in the closed condition of said mating die sections;

(b) an electrical coil member which is connected to a source of electrical energy being inserted into said tubular members so as to extend into said overlapping region within the confines of said annular die; and (c) said coil member having an electrical current applied thereto by said source of electrical energy for imparting an electromagnetic force to the interior of said tubular members in said overlapping region so as to generate a deformation force expanding said tubular members radially outwardly within said overlapping region so as to impress said pattern of recesses on said inner die surface onto said tubular members to produce a corresponding pattern of axial and radial outwardly expanded grooves therein forming said torque joint.

20. A die structure as claimed in claim 19, wherein said tubular members are expanded within said overlapping region to an outer diameter of a size substantially that of the diameter of the configuration of the inner cylindrical surface of said annular die.

21. A die structure as claimed in claim 19, wherein said annular die includes an annular inwardly extending shoulder at one edge of the inner cylindrical surface, said shoulder limiting axial insertion of said tubular members into said die and forming a reduced diameter area on said tubular members adjacent the grooves formed therein upon deformation of said tubular members responsive to said electromagnetic force.

22. A die structure as claimed in claim 19, wherein a plurality of said radial grooves are formed in said tubular members spaced along the length of the formed axial grooves so as to provide a predetermined pattern of grooves reacting to axial and torsional loads imparted to the formed torque joint.

23. A die structure as claimed in claim 19, wherein at least one of said tubular members comprises an end fitting for a torque joint.

24. A die structure as claimed in claim 19, wherein said electromagnetic coil member insertable into said tubular members has an outer diameter substantially the size of the internal diameter of said tubular member within said overlapping region.

* * * * *